United States Patent [19]

Brentham

[11] 4,066,259

[45] Jan. 3, 1978

[54] NECK EXERCISER

[76] Inventor: Jerry D. Brentham, 102 Elm Drive, Belton, Tex. 76513

[21] Appl. No.: 686,164

[22] Filed: May 13, 1976

[51] Int. Cl.[2] ..... A63B 21/00

[52] U.S. Cl. ..... 272/94; 272/130; 272/DIG. 4

[58] Field of Search ..... 272/94, 119, 130, 141

[56] References Cited

U.S. PATENT DOCUMENTS

| | | | |
|---|---|---|---|
| 2,791,999 | 5/1957 | Bustamante | 272/94 |
| 2,855,202 | 8/1958 | Kinne | 272/94 |
| 3,861,677 | 1/1975 | Wheeldon | 272/130 |
| 3,976,057 | 8/1976 | Barclay | 272/130 |

*Primary Examiner*—Richard C. Pinkham
*Assistant Examiner*—Arthur S. Rose
*Attorney, Agent, or Firm*—Howard E. Moore; Gerald G. Crutsinger; Larry B. Dwight

[57] ABSTRACT

A neck exercising device comprising a general frame secured to a wall or the like and a head gripping frame pivotally secured to the general frame such that the axis of rotation of the head gripping frame is aligned with the neck of the user. The head gripping frame has resilient pads which are adjustably secured to the head gripping frame such that the user may urge the pads against the sides of the head to secure the device to the user. A power cylinder is pivotally secured between the general frame and the head gripping frame to provide a resistance to pivotal movement of the head gripping frame about the axis of rotation in both directions. A body restraint member is rigidly secured to the general frame to engage the torso of the user to prevent movement of the lower body of the user, such that all movement of the head is accomplished by the muscles controlling the neck.

15 Claims, 9 Drawing Figures

NECK EXERCISER

BACKGROUND

Exercising devices serve two purposes, to strengthen the muscles and to rehabilitate the muscles. Heretofore neck exercising devices generally comprised devices which placed the neck in traction by a series of ropes and pulleys in which the body is used as weight to pull on the neck or weights are placed upon the rope and pulley to pull on the neck. This tends to exercise the neck muscles in one direction only since the weight pulls the neck in a single direction.

The traction devices which utilize weights require extra equipment and a large storage area for the weights. In addition, supervision is needed for use of traction devices since the devices are not readily controllable by the user. For example, if 75 pounds of weight is placed on the pulley and the user's neck is placed on the traction he would be unable to extricate himself from the device if he became tired, exhausted or hurt himself.

To prevent injuries from occuring to the neck, it is necessary for athletes involved in contact sports to strengthen the neck muscles. The most efficient way to strengthen these muscles is to isolate the neck muscles from the rest of the body since the body has a natural tendancy to use the lower torso to move the neck when the neck is placed under a strain. In addition, many athletes receive injuries and must rehabilitate the neck muscles in order to strengthen the muscles to prevent reoccurrence of the injury.

SUMMARY

I have devised a neck exercising device comprising a general frame secured to a wall or fixed object. Actuating means, such as a head gripping frame, is pivotally secured to the general frame such that the axis of pivotal movement is aligned with the neck of the user. Actuated means, such as a double resistant power cylinder, is pivotally secured between the general frame and the head gripping frame such that pivotal movement of the head gripping frame by the head of the user is resisted.

The head gripping frame has a first set of pads secured to one side and a second set of pads adjustably secured to the other side of the head gripping frame such that the user may tighten the second set of pads against the head such that the head is fixed between the first and second sets of pads.

A body restraint arm extends outwardly from the general frame to engage the lower torso of the user to restrain movement of the lower body when the user pivots his neck about the pivot point of the head gripping frame against the resistance of the power cylinder. Hand grips are provided to further aid in restraining lower body movement.

A primary object of the device is to provide a neck exercising device which isolates the neck muscles to efficiently strengthen neck muscles to prevent injuries to athletes while they are engaged in sporting activites.

A further object of the device is to provide a simple, efficient neck exercising device in which the user completely controls the device thus minimizing the possibility of injury to the user.

A still further object of the invention is to provide a neck exercising device in which the user utilizes his neck muscles to push on the device such that when the user discontinues pushing on the device his head is not under any pressure such that the user may discontinue exercising at any point during the exercise.

A still further object of the invention is to provide a device which will allow the user to flex and extend the neck muscles independently of lower torso movement.

Other and further objects of the invention will become apparent upon referring to the detailed description following and the drawings annexed hereto.

DESCRIPTION OF THE DRAWINGS

Drawings of two preferred embodiments of the invention have been annexed hereto so that the invention will be more fully understood, in which.

Numeral references are employed to designate like parts throughout the various figures of the drawing.

DESCRIPTION OF A PREFERRED EMBODIMENT

Figure 2:
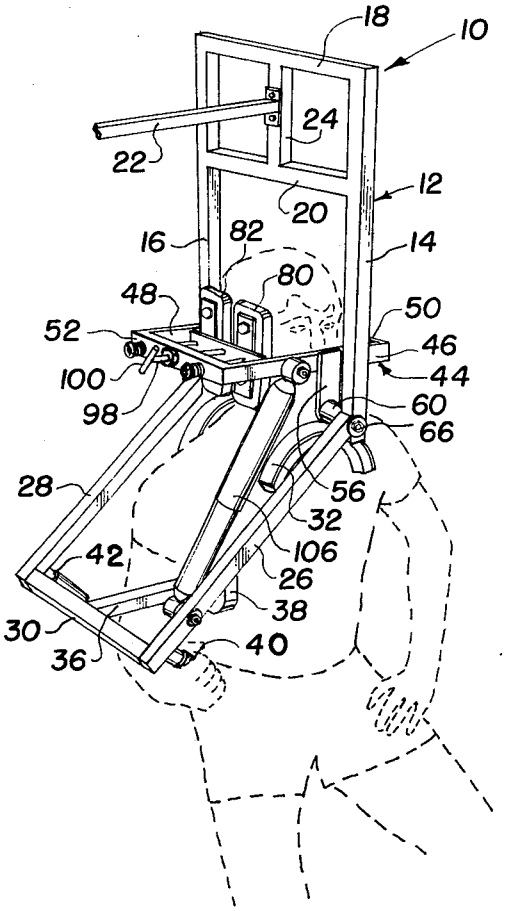
FIG. 2 is a side elevational perspective view thereof with the user diagrammatically illustrated exercising the neck muscles in the lateral position.
Figure 1:
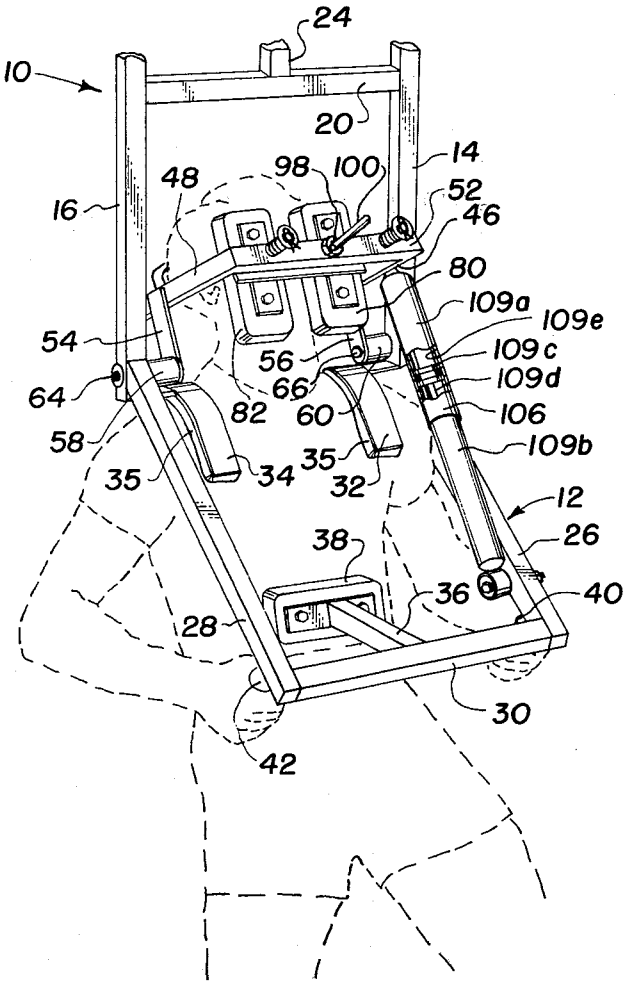
FIG. 1 is a front elevational perspective view of the neck exerciser in which the user is diagrammatically illustrated exercising the neck muscles in the forward position.

Referring to FIGS. 1 and 2 of the drawings, the numeral 10 generally designates the neck exercising device.

The neck exercising device 10 comprises a general frame 12 having a pair of vertically spaced members 14 and 16 welded or otherwise rigidly secured to horizontally spaced members 18 and 20.

The frame 12 is preferably constructed of tubular members having a rectangular cross-section welded together to form a generally rectangularly shaped body. Frame 12 is rigidly secured to a fixed object or wall (not shown) by attachment arm 22 which is bolted or otherwise secured to brace member 24 rigidly secured between horizontal members 18 and 20. Angular brace members 26 and 28 extend outwardly from the lower end of vertical members 14 and 16 and are welded or otherwise rigidly secured to vertical members 14 and 16. A cross-brace 30 is welded or otherwise rigidly secured to the outer end of angular brace members 26 and 28.

As best illustrated in FIG. 1, shoulder braces 32 and 34 are welded or otherwise secured to the lower end of vertical members 14 and 16 to engage the shoulders of the user, diagrammatically illustrated in dashed outline. The shoulder braces 32 and 34 have members 35 secured thereto to engage the user.

Means to restrain the lower body against movement comprises a body stabilizing arm 36 which extends outwardly from the cross member 30 of the general frame 12 and is adapted to engage the torso of the user. A body pad 38 is bolted or otherwise secured to the end of arm 36 and comprises resilient material such as foam rubber covered with plastic or leather to prevent injury to the body of the user. Hand grips 40 and 42 are welded or otherwise rigidly secured to the lower end of angular braces 26 and 28 and are covered with a material such as rubber or plastic.

Actuating means pivotally secured between vertical members 14 and 16 generally comprises a rectangular-shaped frame 44 having side members 46 and 48 welded or otherwise rigidly secured to end members 50 and 52.

Figure 4:
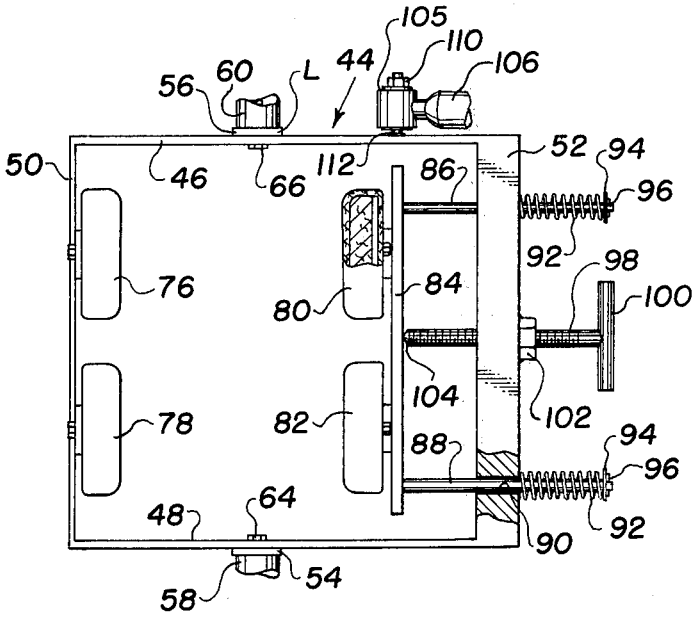
FIG. 4 is a cross-sectional view taken along 4—4 of FIG. 3.
Figure 5:
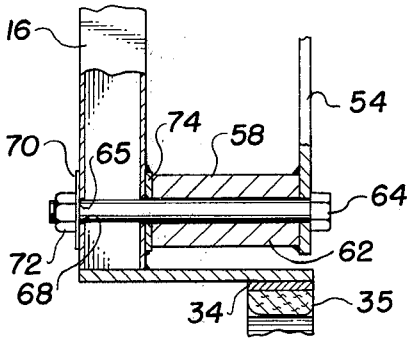
FIG. 5 is a cross-sectional view taken along line 5—5 of FIG. 3.

As more clearly illustrated in FIGS. 4 and 5, side members 46 and 48 have downwardly extending lugs 54 and 56 which are welded or otherwise secured to bushings 58 and 60 respectively. Bushings 58 and 60 have passages 64 formed therethrough. Bolts 64 and 66 extend through passages 62 in bushings 58 and 60 and through passages 68 formed in vertical members 14 and 16. The bolts 64 and 66 have washers 70 and nuts 72 threadedly secured thereto. A shoulder 65 is formed on bolts 64 and 66 to limit tightening of nuts 72. A wear plate 74 is welded or otherwise secured between bushings 58 and 60 and vertical frame members 16 and 14, respectively. It should be readily apparent that bolts 64 and 66 form axles for pivotal movement of frame 44.

Movement of the neck is generally concentrated between the first and second vertebrae of the spine. The first vertebrae forms the atlas and the second vertebrae has a knob or axis which extends into a hollow bore in the first vertebrae to provide movement between the head and the spine. Although movement occurs between each vertebrae, most movement of the neck is concentrated along the upper portion of the cervical spine forming a general point of pivotal movement. The axes of bolts 64 and 66, which coincide with the axes of pivotal movement of frame 44, are preferably closely aligned with this general point of pivotal movement of the neck.

Pads 76 and 78 comprised of a resilient foam covered with plastic or leather are bolted or otherwise secured to end member 50 to grip a portion of the head of the user. Adjustable pads 80 and 82 are bolted or otherwise secured to bar 84 which has support members 86 and 88 welded or otherwise secured thereto such that the support members 86 and 88 extend outwardly and through passages 90 formed in end member 52 of frame 44. Adjustable pads 80 and 82 are spring-urged outwardly by resilient means such as springs 92. Springs 92 urge washers 94 outwardly and washers 94 are secured to support members 86 and 88 by cotter pins 96 or the like such that pads 80 and 82 are spring-urged away from the user's head.

Means to adjust pads 80 and 82 comprises an adjusting screw 98 having a handle 100, threadedly secured through nut 102 which is aligned with a passage in end member 52. Nut 102 is welded or otherwise secured to end member 52 of frame 44 such that rotation of handle 100 urges end 104 of screw 98 against bar 84 urging the pads 80 and 82 inwardly against the side of the user's head. Rotation of handle 100 in the opposite direction will release pads 80 and 82 from the user's head.

Actuated means such as a two-way resistive cylinder 106 is pivotally secured between the general frame 12 and frame 44.

Figure 3:
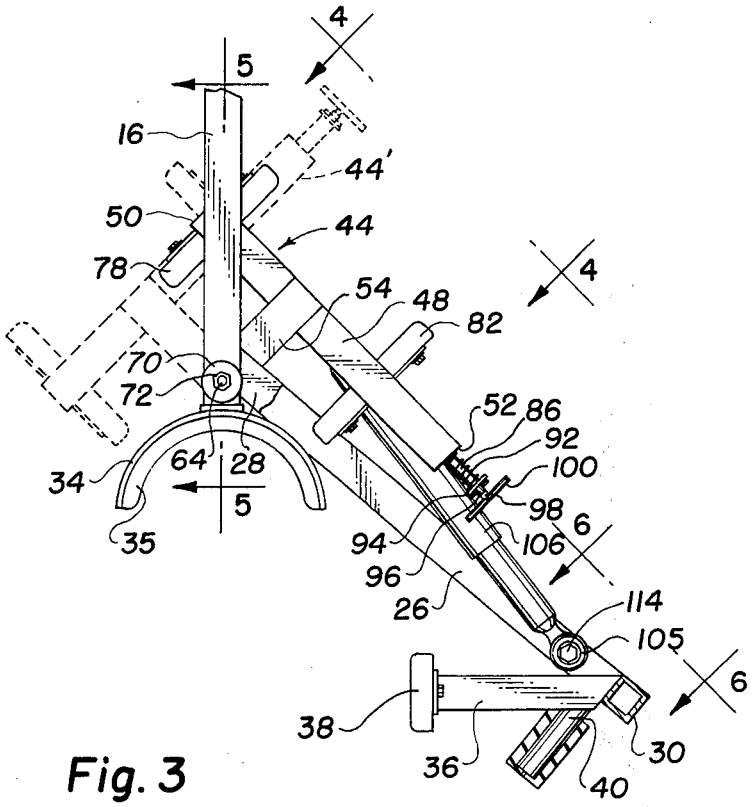
FIG. 3 is a side elevational view, parts being broken away to more clearly illustrate details of construction.

The cylinder 106 is of the type similar to a standard motorcycle racing shock absorber. It provides substantially equal resistance to pivotal movement of frame 44 about bolts 64 and 66 in both clockwise and counterclockwise directions as viewed in FIG. 3. The cylinder 106 resists movement but does not move the head of the user. A first end of cylinder 106 is pivotally secured to side member 46 of frame 44 by a nut 110 threadedly secured to a threaded stub shaft 112 welded or otherwise secured to side member 46.

Cylinder 106 generally comprises a cylindrical member 109*a* having a smooth cylinder wall 109*e* formed therein and a piston rod 109*d*. Movement of the piston 109*c* in the cylindrical member 109*e* is restrained by a fluid dampening means.

The fluid dampening means comprises an orifice or other restricted valving formed in the piston 109*c* to restrict the flow of fluid from cylinder 109*a* to a reservoir (not shown) in the rod end 109*b* of cylindrical member 109*a* which resists movement of piston 109*c*, and consequently frame 44.

Figure 6:
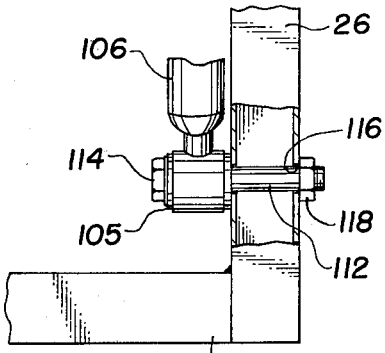
FIG. 6 is a cross-sectional view taken along the line 6—6 of FIG. 3.

As more clearly illustrated in FIG. 6, the opposite end of cylinder 106 is pivotally secured to bolt 114 which extends through a passage 116 formed in angular brace 26 and is secured thereto by nut 118. Each end of cylinder 106 is provided with rubber bushings 105 to allow pivotal movement.

From the foregoing it should be readily apparent that movement of the head by the neck muscles is accomplished by pushing against pads 76 and 78 or pads 80 and 82 to extend and retract cylinder 106. As illustrated in FIG. 1, when the user is engaged in the forward and rearward position, movement of the neck to the rear extends the cylinder 106 and pushing of the head to the forward position retracts cylinder 106. As illustrated in FIG. 2, when exercising the lateral muscles, movement to the right retracts cylinder 106 and movement of the left extends cylinder 106.

The four movements of neck to the left and right and to the front and rear exercise all of the muscles in the shoulder and neck involved in movement of the head. These muscles include, but are not limited to, the platsma myoides, sternocleidomastoid, omohyoid, sternohyoid, trapezius, spenius catitis, splenius cervicis, levator scaeulae, and supraspinatus. These muscles control most of the movement of the head and must be strengthened or rehabilitated in order to avoid injury to the neck in contact sports such as football, soccer and basketball.

From the foregoing it should be readily apparent that the body stabilizing arm 36 engages the torso. Hand grips 40 and 42 aid in preventing movement of the lower torso. As viewed in FIG. 1, the stationary arm 36 engages the abdomen of the user and the shoulder braces 32 and 34 engage the shoulders of the user to prevent movement toward the front and rear of the lower torso.

As viewed in FIG. 2, for lateral movement of the head the stationary arm 36 engages the side of the body torso with the arm wrapped around engaging one of the hand grips 42 to prevent movement of the lower torso when using the device in that position.

Operation of the hereinbefore described device is as follows:

To exercise the neck muscles which control forward and rearward movement of the head, the athlete positions his body, as illustrated in FIG. 1, with his shoulders engaging shoulder braces 32 and 34. Handle 100 is rotated to urge the end 104 of screw 98 against bar 84 urging adjustable pads 80 and 82 against the forward portion of the head. A user then grips hand grips 40 and 42 and flexes the rearward muscles by movement of the head backwards, extending cylinder 106. As the athlete flexes his muscles to move his head forward, the cylinder 106 resists the movement.

The body stabilizing arm 36 is engaged against the abdomen to prevent movement of the lower torso.

For lateral neck flexion to the left and right, the athlete rotates his body 90° relative to the position used to exercise the front and back neck muscles such that the stationary arm 36 engages the side of the body. The athlete tightens handle 100 urging pads 80 and 82 against the side of the athlete's head restraining the head between pads 76 and 78 and 80 and 82. Movement toward the left extends cylinder 106 and movement toward the right compresses cylinder 106 for flexion of the muscles in each direction.

After the athlete has performed a set number of movements, the handle 100 is turned to release the pads 80 and 82 from the head of the athlete.

SECOND EMBODIMENT

Figure 8:
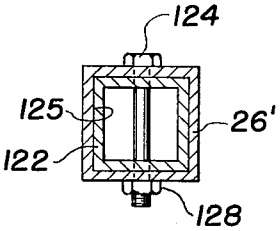
FIG. 8 is a cross-sectional view taken along line 8—8 of FIG. 7.
Figure 9:
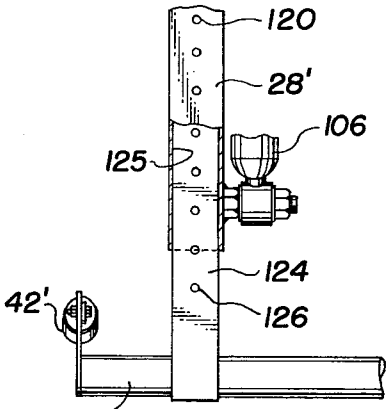
FIG. 9 is a cross-sectional view taken along line 9—9 of FIG. 7.
Figure 7:
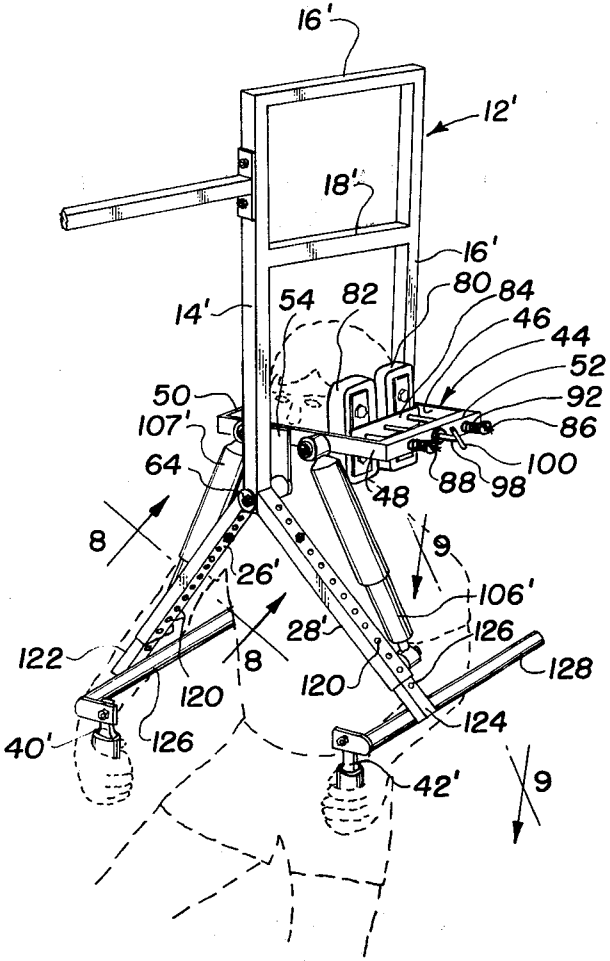
FIG. 7 is a front elevational perspective view of a modified form of the neck exercising device.

A modified form of the neck exercising device is illustrated in FIG. 7–9. The general frame 12' comprises vertical support members 14' and 16' spaced apart by horizontal support member 16' and 18'. The actuating frame 44, substantially the same as hereinbefore described, is pivotally secured between the lower ends of vertical members 14' and 16' by bolts 64 and 66.

Angular brace members 26' and 28' extend downwardly and outwardly from opposite sides of the lower end of vertical member 14'. Angular brace members 26' and 28' have a plurality of apertures 120 formed therein. As more clearly illustrated in FIGS. 8 and 9, the hollow angular brace members 26' and 28' have extension members 122 and 124 slideably disposed through the hollow cavity 125 formed in angular braces 26' and 28'. Bolts 124 are slideably disposed through one or more of the apertures 120 formed in brace members 26' and 28' and extend through one of a plurality of passages 126 formed in extension members 122 and 124 and are secured thereto by nuts 128. It should be readily apparent that the length of angular brace members 26' and 28' may be adjusted by movement of extension members 122 and 124 within the respective tubular members.

A pair of cylinders 106' and 107' are pivotally secured between side member 48 of frame 44 and angular braces 26' and 28'.

Body retension bars 126 and 128 are welded or otherwise secured to the lower end of extension members 122 and 124 to restrain the lower torso of the user from movement. Hand grips 40' and 42' are bolted or otherwise secured to body retension bars 126 and 128 such that the relative heighth of the bars may be adjusted by movement of the extension members 122 and 124 in braces 26' and 28'.

From the foregoing it should be readily apparent that each of the embodiments hereinbefore described accomplishes the objects of the invention hereinbefore discussed.

It should be appreciated that other and further embodiments of the invention may be devised without departing from the basic concept thereof.

Having described my invention, I claim:

1. A neck exercising device comprising: a general frame; shoulder restraints rigidly secured to the general frame and adapted to engage the shoulders of the user; actuating means pivotally secured to the general frame; actuated means pivotally secured between the general frame and the actuating means; and head gripping means secured to said actuating means, such that pivotal movement of a neck of a user moves said actuating means and movement of said actuating means is resisted by the actuated means.

2. The combination called for in claim 1 wherein the head gripping means is adjustably secured to the actuating means.

3. The combination called for in claim 2 wherein the adjustable head gripping means comprises: a resilient pad; and means to urge said resilient pad against a side of the head.

4. The combination called for in claim 1 with the addition of: a body restraint means; and means securing said body restraint means to said general frame to prevent movement of the lower torso of a user.

5. The combination called for in claim 1 with the addition of: means pivotally securing the actuating means to the general frame such that the axis of rotation of the actuating means relative to the general frame is aligned with the general axis of rotation of the head relative to the torso of the user.

6. The combination called for in claim 1 with the addition of: hand restraints secured to the general frame.

7. The combination called for in claim 1 wherein the actuating means comprises: a frame; and wherein said head gripping means comprises padded cushions secured to said frame and adapted to be urged inwardly.

8. The combination called for in claim 1, said general frame comprising: first and second vertically extending members; means supporting said first and second vertically extending members in spaced relation; a pair of brace members; means angularly securing said brace members to the lower ends of said first and second vertically extending members; means securing outer ends of said brace members in spaced relation; and means to pivotally secure said actuating means to the lower end of said vertically extending members.

9. The combination called for in claim 8, with the addition of a body restraint arm; and means securing said body restraint arm to said means securing said brace members in spaced relation.

10. The combination called for in claim 1, the actuated means comprising: a hollow cylinder; means pivotally securing one end of said cylinder to said general frame; a piston rod; a piston secured to said rod, said piston being slideably disposed in said cylinder; seal means on said piston to seal between the piston and cylinder; dampening means to resist movement of said piston in said cylinder; and means pivotally securing an end of said piston rod to said actuating means.

11. A neck exercising device comprising: first and second vertically extending members; means supporting said first and second vertically extending members in spaced relation; a pair of brace members; means angularly securing said brace members to the lower ends of said first and second vertically extending members; means securing outer ends of said brace members in spaced relation; actuating means; means pivotally securing said actuating means to the lower ends of said vertically extending members; actuated means; means pivotally securing said actuated means between one of the brace members and the actuating means; and head gripping means secured to said actuating means, such that pivotal movement of a neck of a user moves said actuating means and movement of said actuating means is resisted by the actuated means.

12. The combination called for in claim 11 with the addition of shoulder restraints; and means rigidly securing said shoulder restraints to said first and second vertically extending members, said shoulder restraints being adapted to engage the shoulders of the user.

13. A neck exercising device comprising: a general frame; a rigid head engaging pad support frame; means pivotally securing said rigid head engaging pad support frame to said general frame; head engaging pads; means securing said head engaging pads to said rigid head engaging pad support frame; actuated means pivotally secured between the general frame and the rigid head engaging pad support frame, such that pivotal movement of the head of the user moves said rigid head engaging pad support frame and movement of said rigid head engaging pad support frame is resisted by said actuated means; and restraint means projecting from said general frame, said restraint means including a rigid portion adapted to transmit a force to the body of the user to prevent movement of the head relative to the body of the user except where that movement in turn causes movement of the rigid head-engaging pad support frame relative to the general frame.

14. The combination called for in claim 13 wherein the restraint means comprises shoulder engaging means secured to said general frame and adapted to engage the shoulders of the user.

15. The combination called for in claim 13, said general frame comprising: first and second vertically extending members; means supporting said first and second vertically extending members in spaced relation; a pair of angularly disposed brace members; means rigidly securing said brace members to a lower end of said first vertically extending member; and means pivotally securing said actuating means between the lower ends of said first and second vertically extending members.

* * * * *